US008186332B2

(12) United States Patent
Sturgess

(10) Patent No.: US 8,186,332 B2
(45) Date of Patent: May 29, 2012

(54) FLUID FILTER WITH INTEGRATED TEMPERATURE REGULATION

(75) Inventor: Christopher Marc Sturgess, Auburn Hills, MI (US)

(73) Assignee: Mann & Hummel GmbH, Ludwigsburg (DE)

( * ) Notice: Subject to any disclaimer, the term of this patent is extended or adjusted under 35 U.S.C. 154(b) by 312 days.

(21) Appl. No.: 12/505,570

(22) Filed: Jul. 20, 2009

(65) Prior Publication Data

US 2011/0011372 A1 Jan. 20, 2011

(51) Int. Cl.
*F02M 37/22* (2006.01)
*F02M 37/00* (2006.01)

(52) U.S. Cl. ..... 123/514; 123/196 A

(58) Field of Classification Search ..... 123/514, 123/510, 456, 196 A, 553, 558, 557; 210/149
See application file for complete search history.

(56) References Cited

U.S. PATENT DOCUMENTS

| | | | | |
|---|---|---|---|---|
| 4,574,762 | A * | 3/1986 | Muller et al. | 123/510 |
| 4,618,417 | A * | 10/1986 | Yamanouchi et al. | 210/149 |
| 5,746,170 | A | 5/1998 | Moriya | |
| 5,832,902 | A * | 11/1998 | Davis et al. | 123/514 |
| 5,988,514 | A * | 11/1999 | Huang | 236/12.14 |
| 6,179,577 | B1 | 1/2001 | Meyer | |
| 6,289,879 | B1 * | 9/2001 | Clausen et al. | 123/516 |
| 7,192,518 | B2 | 3/2007 | Roesgen | |
| 2007/0062494 | A1 * | 3/2007 | Yanagi et al. | 123/514 |

FOREIGN PATENT DOCUMENTS

| | | | |
|---|---|---|---|
| DE | 3427396 | A * | 1/1986 |
| EP | 1302711 | A1 | 4/2003 |

* cited by examiner

*Primary Examiner* — Mahmoud Gimie
(74) *Attorney, Agent, or Firm* — James Hasselbeck

(57) ABSTRACT

A fluid filter module with a filter housing is provided with an integrated and internally mounted thermostatic fluid regulator valve. The regulator valve is equipped with a thermostatic actuator member configured to sense and regulate a mix temperature within the filter housing. The regulator valve is configurable as a separate component installable into the filter housing.

18 Claims, 3 Drawing Sheets

FIG. 3A
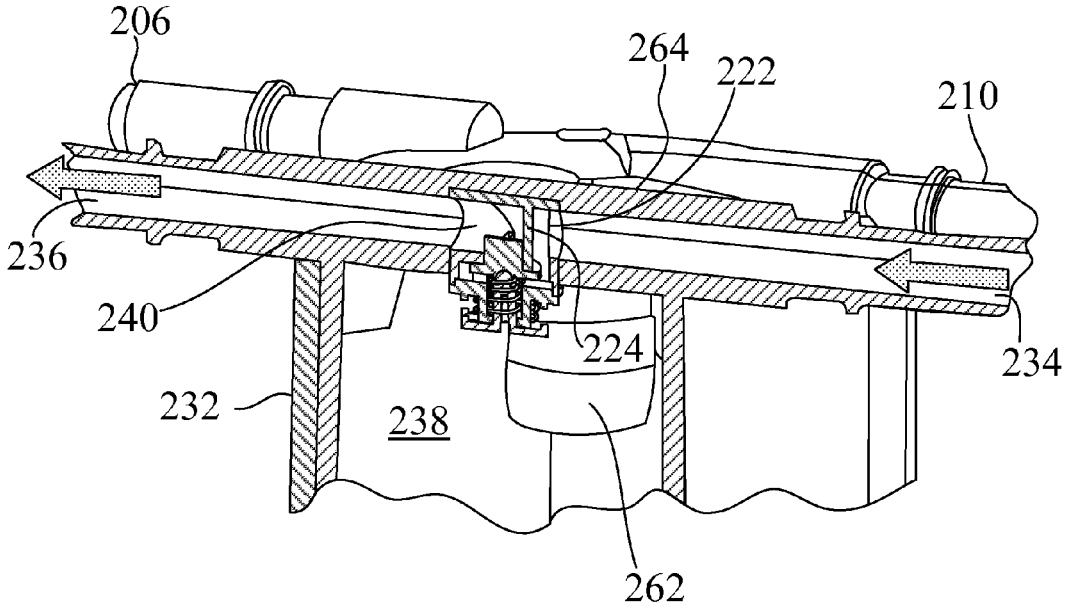
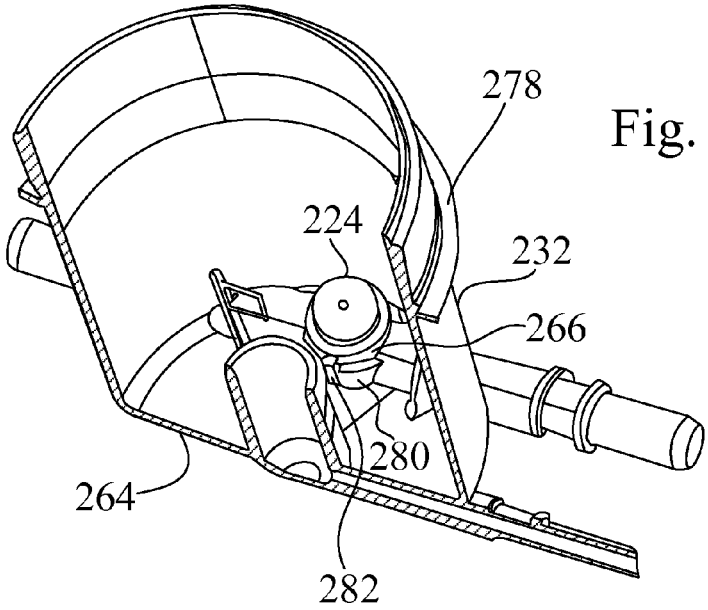
Fig. 3B

FLUID FILTER WITH INTEGRATED TEMPERATURE REGULATION

TECHNICAL FIELD

The invention relates to fluid filter devices, and more particularly, to fluid filter devices having integrated thermostatic fluid temperature regulation configured to control the mixing of preheated fluid with unheated fluid within the filter chamber.

BACKGROUND OF THE INVENTION

One example application is in internal combustion engine fuel delivery systems. Fuel delivery systems for internal combustion engines are configured to draw fuel from the fuel tank and deliver it to the engine and may include a fuel pump and fuel filter. A fuel pump may provide the elevated pressures required by fuel injection systems. A fuel filter is typically provided and often interposed between the fuel tank and fuel pump to remove contaminant materials that may be present in the fuel supply.

Internal combustion engines may be configured to operate on a variety of fuel types. Internal combustion engines may utilize fuel varieties that are substantially more viscous in cold weather conditions (for example, diesel fuel) than is the case for other fuels (for example, gasoline). To improve operation of these engines in cold temperatures and to reduce fuel viscosity it is useful to provide a means to controllably mix preheated fuel with unheated fuel in the fuel supply delivered to the fuel filter and ultimately to the engine.

There are known solutions in the art. For example, EP1302711 discloses a thermostatic valve for a fuel supply to a diesel engine. The valve includes a movable valve member slideable within a valve body chamber utilizing radial sealing of the valve member to the valve body. A shape memory alloy component is provided to actuate the valve member at a transformation temperature. Unfortunately, this valve assembly has a number of disadvantages. The thermostatic valve senses the fuel temperature flowing into the inlet port of the valve (i.e., return fuel from the engine). This design, as it senses and responds to only the much warmer fuel return temperature, therefore does not provide the necessary control of the diesel fuel supply temperature to the engine. Another limitation is in the design wherein the valve member utilizes radial sealing to the valve body. Radial sealing is disadvantageous as the radial sealing gives rise to the need for tight tolerances between the valve member and the valve chamber walls. Free movement of the valve member inside the valve body relies upon maintaining very clean wall conditions between the sealing surfaces of the sliding valve member and the valve body wall against which the valve member slides. We have found that similar designs have shown problems where the valve member will catch or hang-up on debris that may accumulate between the sliding surfaces, a condition aggravated by the relatively tight tolerances of radial sealing. On the other hand, reducing the outside diameter of the valve member in EP1302711 to reduce the chance that the valve will "stick" will necessarily result in internal leakage paths that interfere with the accurate operation of the valve.

Another reference, U.S. Pat. No. 5,746,170 discloses a thermostatic valve disposed in an oil filter mounting block including a shape memory alloy member configured to actuate the valve on rising temperature to reroute oil flow to an oil cooler.

While such solutions are serviceable for their disclosed uses, they are disadvantageous from a fuel system operation and total system cost point of view. Therefore a better solution for controlling fuel temperature that is realizable at a lower cost, provides better control of delivered fuel temperature and is more easily implemented is desirable.

SUMMARY OF THE INVENTION

In aspects of the invention a fluid filter module includes a filter housing having a fluid inlet port, a fluid outlet port and a chamber for receiving a fluid filter element therein. A thermostatic fluid regulator valve is integrated into the filter housing and includes a valve body defining a valve inlet port, a valve outlet port and a recirculation passage with the recirculation passage in fluid communication with the chamber of the filter housing. A valve member is provided in the valve body and is movable between a first position and a second position for redirecting fluid flow. In the first position the valve inlet port is in communication with the recirculation passage and the valve outlet port is blocked. When in the second position, the valve inlet port is in communication with the valve outlet port and the recirculation passage is blocked. An actuator member responsive to fluid mix temperature is provided and configured to have a predefined desired actuation temperature. The actuator member is operational to urge the valve member into the second position when the mix temperature warms to the actuation temperature. The mix temperature corresponds to a thermal blending of fluid entering the fluid inlet port together with fluid exiting the recirculation passage within the chamber.

In another aspect of the invention, hydraulic pressure of the fluid is operable to move the valve member from the second position to the first position when mix temperature drops below the predefined actuation temperature and the actuator is no longer urging the valve member into the second position.

In another aspect of the invention, the fluid regulator valve includes at least one reset spring member configured to elastically urge the valve member into the first position when mix temperature drops below the predefined actuation temperature and the actuator is no longer urging the valve member into the second position.

In another aspect of the invention, the actuator member includes a shape memory alloy having a transformation temperature, the shape memory alloy changing in shape when the fluid warms to the transformation temperature so as to urge the valve member into the second position. The transformation temperature is determined from the desired actuation temperature, matching the actuation temperature or differing from the desired actuation temperature by a predetermined amount so as to tune system temperature regulation to the predefined actuation temperature.

In another aspect of the invention, the valve body includes an outlet seat and a recirculation seat. The seats are configured to permit closeable sealing against the valve member to perform the fluid redirection. The valve body and the seats are configured for closeable fluid sealing, specifically in axial direction relative to movement of the valve member.

In another aspect of the invention, the valve member includes a two-sided valve disc configured to enable axial sealing of the valve member against a maximum of one of the seats at a time.

In another aspect of the invention, the actuator member is a coiled shape memory alloy spring with the reset spring member and the actuator member arranged concentrically and acting opposingly.

In another aspect of the invention, the valve body is substantially "T" shaped. The reset spring member is received about a valve shaft and the shaft is secured at one end to the valve member and secured at an opposing end to an actuator engagement member. The actuator member is configured to engage against the valve body at a first end and is engageable against the actuator engagement member at a second end.

In another aspect of the invention, the regulator valve and filter housing comprise molded plastic resin.

In another aspect of the invention, the filter housing includes a receptacle sized and configured to mountably receive the fuel regulator valve therein. The regulator valve is realized as a separate standardized component applicable to and selectably installable into multiple filter housing types. Additionally, the regulator valve is configured for snap-in assembly into the receptacle.

In another aspect of the invention, the receptacle includes curved wing portions configured to provide fluid flow closure between the receptacle and the valve body.

In another aspect of the invention, the actuator member is a nitinol shape memory alloy coil spring.

In another aspect of the invention, the fuel regulator valve is positioned within the filter housing chamber such that any leakage from the valve is contained within the filter housing.

In another aspect of the invention, a fuel delivery system for an internal combustion engine includes a fuel filter as described above with the inlet port in communication with a fuel return line from the engine; the outlet line in communication with a second fuel return line to a fuel tank; the fuel inlet port in communication with a fuel supply line from the fuel tank; and the fuel outlet port in communication with a pump configured to draw the fuel from the tank through the filter.

The above features and advantages and other features and advantages of the present invention are readily apparent from the following detailed description of the best modes for carrying out the invention when taken in connection with the accompanying drawings.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

FIG. 3A illustrates a partial side sectional view of an exemplary embodiment of a fluid filter housing incorporating the temperature regulator valve of FIGS. 2A,2B; and FIG. 3B illustrates a sectional side view of the fluid filter housing of FIG. 3A as viewed in a generally upwards direction looking towards the filter housing top portion.

Figure 1:
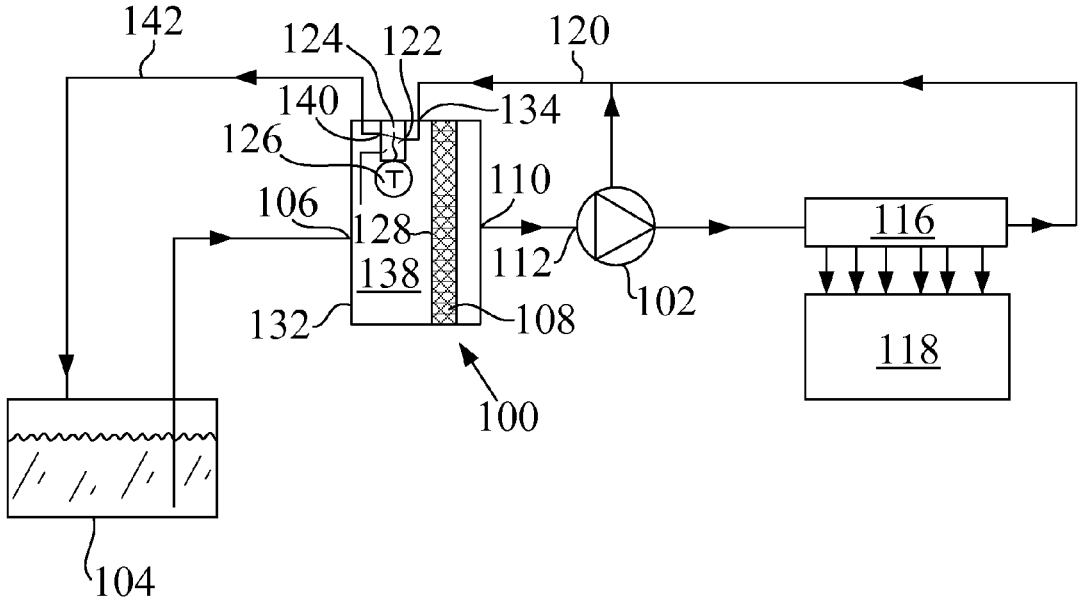
FIG. 1 is a schematic diagram of an improved fuel flow circuit for an engine, consistent with the present invention.

Skilled artisans will appreciate that elements in the figures are illustrated for simplicity and clarity and have not necessarily been drawn to scale. Skilled artisans will also understand that the specific exemplary embodiments illustrated in FIGS. 2A, 2B, 3A and 3B are presented to provide a better understanding of the inventive concepts disclosed herein and are not intended to be limiting. For example, it is envisioned and well understood that the valve member, valve body and filter housing may be realized in other shapes and configurations without deviating from the inventive concepts presented herein. Furthermore, the dimensions of some of the elements in the figures may be exaggerated relative to other elements to help to improve understanding of embodiments of the inventive concepts presented herein.

DETAILED DESCRIPTION

Before describing in detail embodiments that are in accordance with the present invention, it should be observed that the embodiments reside primarily in combinations of method steps and apparatus components related to a fluid filter including an integrated fluid temperature regulator and method for regulating fluid temperature as disclosed herein. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

FIG. 1 is a schematic diagram of an improved fuel flow circuit for an engine illustrating features of the invention. A transfer pump 102 draws fuel from a fuel tank or reservoir 104 into the fuel inlet port 106 of the fluid filter 100 in which the fuel is filtered through the fluid filter element 108, then exits the fluid filter 100 through the fuel outlet port 110 to be drawn to the suction side 112 of the transfer pump 102.

In the illustrated example, the transfer pump 102 is operative to deliver pressurized fuel to the engine 118, for example to and for distribution by the fuel rail 116. In FIG. 1 the fuel rail 116 supplies pressurized fuel to the engine 118, for example to the fuel injectors (not shown). Some portion of the fuel quantity supplied to the fuel rail 116 is not consumed by the engine 118 but is instead recirculated back via the return line 120 to the valve inlet port 122 of the thermostatic fuel regulator valve 124. The temperature of the fluid in the return line 120 may vary and is typically greater than the temperature of the fuel in the fuel reservoir 104 due at least in part to the mechanical action (conversion of kinetic energy into heat)

of the transfer pump 102 on the pumped fluid and to some degree due to the heat (convection, conduction or radiant heat) received at the fuel rail 116 from the engine 118.

Certain types of fuels, one illustratory example being diesel fuel, have a viscosity that is dependent upon temperature and may become relatively viscous at lower ambient temperatures. For these fuel types it may be desirable to utilize the heated temperature of the recirculated fuel (for example, fuel in the return line 120) to preheat the fuel entering the filter element 108, thereby reducing the fuel viscosity, reducing the chance of filter element blockage, reducing the resultant pressure drop across the filter element 108 and providing for less restricted flow of fuel to the engine 118.

As illustrated schematically in FIG. 1, according to the inventive disclosure herein a fluid filter 100 is provided that integrates within the filter housing 132 a replaceable fluid filter element 108 and a temperature regulator valve 124 into a single unitary fluid filter 100. In the depicted example, the thermally warmed recirculated fluid from the engine 118 or fuel rail 116 is delivered to the recirculation inlet port 134 at the filter housing 132 which connects to the valve inlet port 122 of the temperature regulator valve 124. The temperature regulator valve includes a valve member (not shown) that in a first position redirects the recirculated fluid flow back into the filter housing chamber 138, specifically at the inlet side 128 of the filter element 108. In a second position the temperature regulator valve 124 redirects the warmer recirculated fluid to the valve outlet port 140 to return to the fuel reservoir 104 such as through the fuel reservoir return line 142.

The fuel regulator valve 124 includes a temperature sensitive actuator member 126 positioned and configured to sense and to be responsive to a mixture temperature (mixture of the recirculated fluid and the fluid drawing from the tank) as present at the inlet side 128 of the filter element 108. The temperature sensitive actuator member 126 is configured and adapted to moveably position the valve member according to the sensed mixture temperature so as to realize mixture temperature control.

Figure 2A:
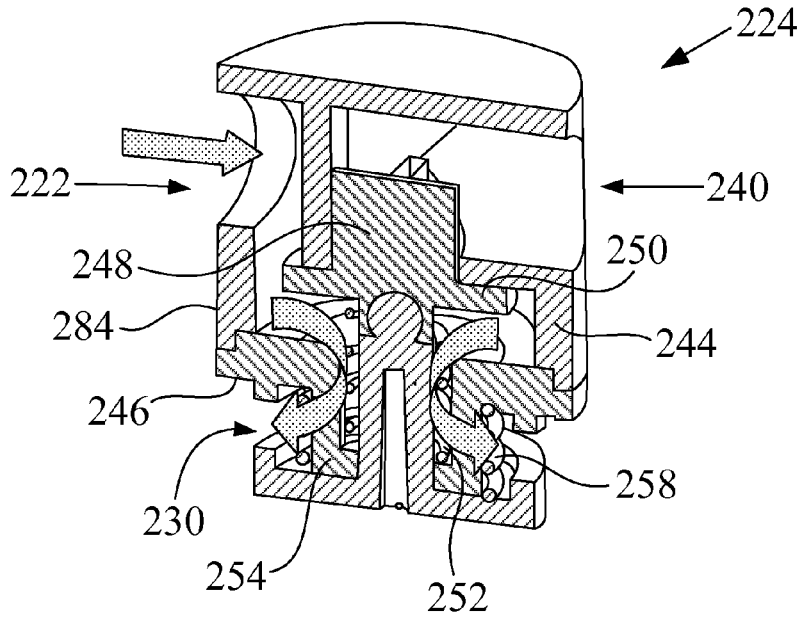
FIG. 2A depicts a perspective side sectional view of the temperature regulator valve when the mix fluid is below a predetermined desired fluid temperature setting, consistent with at least one embodiment of the present invention.
Figure 2B:
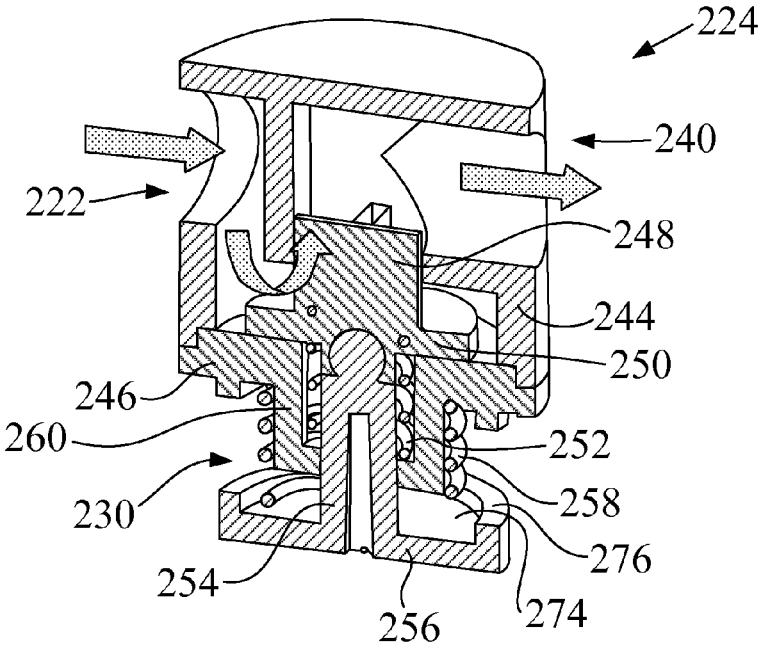
FIG. 2B depicts a perspective side sectional view of the temperature regulator valve when the mix fluid is above a predetermined desired fluid temperature setting, consistent with at least one embodiment of the present invention.

FIGS. 2A and 2B depicts one specific illustratory non-limiting exemplary embodiment of the temperature regulator valve 224 consistent with the teaching of the inventive disclosure herein. FIG. 2A depicts a perspective side sectional view of the temperature regulator valve 224 when the mix fluid temperature (in the filter housing chamber 138 at the inlet side of the filter element 108) is below a predetermined (preconfigured) desired fluid temperature setting. FIG. 2B depicts a perspective side sectional view of the temperature regulator valve 224 of FIG. 2A with the mix fluid temperature (in the filter housing chamber 138 at the inlet side of the filter element 108) at or above the predetermined desired fluid temperature setting.

In the example embodiment illustrated, the temperature regulator valve 224 is shown with a generally cylindrical valve base 244 having secured at one end a valve cap member 246 which may be either detachably connected or permanently bonded to each other. A valve member 248 is provided in the regulator valve and is movable between a first position (shown in FIG. 2A) and a second position (shown in FIG. 2B).

In the first position (FIG. 2A), the valve member 248 has a valve disc 250 configured and positioned to block flow to the valve outlet port 240 while placing the valve inlet port 222 in fluid communication with the recirculation passage 230. FIG. 2A and position one are illustrative of the temperature regulator valve 224 configuration in operating conditions when the mix temperature is below the predetermined desired fluid temperature setting.

Then in FIG. 2B, the valve member 248 has moved downwards to place the disc 250 in a position to block fluid flow to the recirculation passage 230 while placing the valve inlet port 222 in fluid communication with the valve outlet port 240. FIG. 2B and position two are illustrative of the temperature regulator valve 224 configuration in operation when the mix temperature is at or above the predetermined desired fluid temperature setting.

The valve member 248 is moveably positioned (vertically in FIGS. 2A and 2B) by the counteracting forces applied by the temperature sensitive actuator member (in this specific illustrated embodiment, shape memory alloy spring 258) and the reset spring 252. The reset spring 252 is positioned inside the valve body under the valve cap 246. The reset spring is partially compressed between the interior of the valve cap 246 and the valve disc 250, thereby urging the valve member 248 into position one (position illustrated by FIG. 2A). Mountably secured to the valve member 248 by a valve stem 254 is actuation disc 256 which includes a cup-like inner surface 274 with a peripheral lip 276 configured to retain and compress against one end of a shape memory alloy actuator spring 258. The shape memory alloy actuator spring 258 is supportively received about a cylindrically shaped protruding portion 260 of the valve cap 246. Forces applied to move the valve member 248 result from differences arising in counteracting forces applied by the reset spring 252 and shape memory actuator spring 258 as coupled through the valve stem 254, these force differences depending upon mix temperature.

For a background discussion—Shape memory alloy (SMA, also known as a smart metal, memory alloy, or muscle wire) is an alloy that "remembers" its shape, and can be returned to that shape after being deformed, by the application of heat to the alloy. The three main types of SMA are the copper-zinc-aluminum-nickel, copper-aluminum-nickel, and nickel-titanium (NiTi) alloys. Nickel-titanium SMA is also known as "Nitinol".

When a shape memory alloy is in its cold state (below the transition temperature), the SMA metal can be bent or compressed into new shapes and will hold that shape until it is heated above the transition temperature. Upon heating above the transition temperature, the shape memory alloy (spring) returns to its original shape. This temperature triggerable shape memory attribute is advantageously applied to provide temperature sensitive actuation of the temperature regulator valve 224 to transition between the cold condition (FIG. 2A, position 1) and the warm (or hot) condition (FIG. 2B, position 2).

In FIG. 2A, the shape memory actuator spring 258 is illustrated in a cold condition, i.e. below its transformation temperature. In this condition, the shape memory actuator spring 258 is configured to be compressively deformed by the force applied by the reset spring 252 as transmitted through the valve stem 254 to the actuation disc 256. In FIG. 2A and using the fluid circuit example of FIG. 1, recirculated heated fluid from the engine 118 or fuel rail 116 is communicated from the valve inlet port 222 to the recirculation passage 230 of the valve 224. The recirculation passage 230 discharges the heated fluid into the chamber of the fuel filter housing (as will be shown and discussed below with FIG. 3).

The shape memory actuator spring 258 is calibrated such that it's predetermined or configured transformation temperature results in a desired minimum fluid (or fuel) temperature. Fuel viscosity increases with decreasing fuel temperature. The actuator is calibrated to ensure that the regulator valve 224 maintains a sufficiently warm fuel temperature to maintain at least a minimal flow of fuel through the filter element 108 so as to provide the fuel pump 102 with a sufficient fuel flow rate and pressure to permit the operation of the engine 118 at low ambient temperatures when the increased viscosity of the fuel (at low temperature) might otherwise result in blockage of the filter 108. The shape memory actuator 258 is positioned in and in thermal communication with the mixing inlet fluid from the fuel inlet port 106 and the recirculated fluid from the recirculation passage 230 as present at the inlet side 128 of the replaceable filter element 108. As this mixture temperature rises above the transformation temperature, the shape memory actuator 258 returns to its undeformed shape (by shape memory), therefore elongating to its original length and thereby compressing the reset spring 252, thereby moving the valve member 248 to position 2 (as depicted in FIG. 2B).

Later, when the engine is shutdown and the fluid temperature cools, the shape memory actuator 258 cools below its transformation temperature and thereby responds to either fluid forces or forces applied by a reset spring 252 (depending upon design), either being operative to return the temperature regulator valve 224 to its cold condition (first position as illustrated in FIG. 2A). In some embodiments where a reset spring is used, the reset spring may be realized as a steel or stainless steel compression spring.

Through the counteracting forces applied by the shape memory actuator acting against the reset spring (as discussed in detail above), temperature responsive operation of the temperature regulator valve 224 is advantageously responsive to the mix temperature of the fluid at the inlet side 128 of the filter element 108 within the fluid filter housing 132.

FIG. 3A illustrates a partial side sectional view of one envisioned exemplary embodiment of a fluid filter housing 232 having an integrated temperature regulator valve 224 (such as presented and discussed with FIGS. 2A,2B) mounted into a top portion 264 of the housing 232 with the valve inlet port 222 in communication with the recirculation inlet port 234 and the valve outlet port 240 in communication with the recirculation outlet port 236 of the fluid filter housing 232. The temperature regulator valve 224 is mounted in a position within the filter housing 232 interposed between and in fluid communication with the recirculation inlet port 234 and the recirculation outlet port 236. The receptacle 266 provided or formed into the housing 232 is sized and configured to mountably receive the regulator valve 224. The regulator valve 224 is positioned within the chamber 238 of the filter housingh232 with the shape memory actuator 258 positioned to be exposed to and in thermal communication with the mix fluid temperature at the inlet side of the filter element (filter element 108 shown schematically in FIG. 1). Also shown on the fuel filter housing 232 in FIG. 3 is the fuel inlet port 206 through which fuel enters the filter housing and the fuel outlet port 210 where filtered fuel is discharged from the housing. The fluid filter housing 232 is configured to receive a generally cylindrical filter element through which fluid flows radially from the outside of the filter element towards an interior of the filter element to leave the filter element through the tubular protrusion 262 so as to flow to the fuel outlet port 210 of the housing 232.

FIG. 3B illustrates a sectional side view of the fluid filter housing 232 presented in FIG. 3A, but viewed in a generally upwards direction looking upwards towards the top portion 264 of the fluid filter housing 232. The filter housing 232 includes a removable filter cover (not shown for better illustration of the regulator valve) that is detachably, closeably and sealably securable to the cover attachment portion 278 of the filter housing 232. The temperature regulator valve 224 is shown installed into the housing 232 via the generally cup-shaped receptacle 266 formed into or provided on the housing top portion 264 and sized/configured to mountably receive the regulator valve 224 at least partially therein. Mounting of the temperature regulator valve 224 into the receptacle 266 of the fluid filter housing 232 may be by way of a snap fit configuration, by the use of adhesives or other mounting methods as known to those skilled in the art.

In a preferred embodiment, the regulator valve 224 includes a positioning tab 282 secured to the outer wall of the regulator valve (for example, the outer wall 284 in FIG. 2B). The positioning tab 282 is oriented on the regulator valve as well as sized and adapted to be received into an alignment slot 286 provided in the wall of the receptacle 266. Cooperation between the position tab 282 and the slot 286 insures correct orientation of the regulator valve during installation. This is important when the regulator valve has a body shape that would otherwise permit the valve to be installed in an incorrect and thereby inoperative orientation.

Advantageously, the depicted valve features (FIGS. 2A and 2B) realize a temperature regulator valve 224 that is very compact in size and therefore easily integrated in the interior chamber 238 of the housing 232 of the fluid filter 100.

Advantageously, the temperature sensitive actuator member (shape memory actuator spring 258 in exemplary embodiments) of the temperature regulator valve 224 is immersed in mixing flow of the fluid entering the fluid inlet port 206 of the heated recirculation flow exiting the recirculation passage 230 of the temperature regulator valve 224, wherein the temperature regulator valve 224 is therefore advantageously responsive to the mixture temperature (fluid entering the filter element to be delivered to the engine) rather than sensing and being responsive to the recirculation fluid temperature, as taught and realized in the prior art. One of the goals of heated fluid recirculation is to warm fuel entering the filter to at least a minimum temperature so as to reduce the viscosity of the fuel to prevent filter clogging. This goal cannot be reliably achieved by sensing only recirculation temperature as in the prior art.

Advantageously, the temperature regulator valve 224 if configured and adapted to be readily press-fit in the cylindrical cup-like receptacle 266 as formed into the fluid filter housing 232 without the need for any additional hardware.

Advantageously, the receptacle 266 includes curved wing wall portions 280 shaped and configured to provide fluid flow closure between the receptacle 266 and the sidewall of the valve base 244 of the temperature regulator valve 224, thereby restricting the fluid stream entering the fuel inlet port 206 to flow through and be controllably diverted by the temperature regulator valve 224 so as to control mixture temperature at the inlet side of the filter element as intended and as described in detail earlier.

Advantageously, the positioning of the temperature regulator valve 224 within the chamber 238 of the fluid filter housing 232 reduces the need to provide for tight tolerances between the valve cap 246 and the valve stem, and between the outer wall of the valve base 244 and the receptacle 266 as any possible minor leakage that may occur is confined within the fuel filled chamber 238 and therefore does not reach the environment. The relaxed need for tight tolerances advantageously further reduces manufacturing costs. Any potential internal leakages are minimal and are not detrimental to the valve itself or to the fluid filter module 100.

Advantageously, the moveable valve member 248 of the temperature regulator valve 224 is configured with a two sided valve disc 250 further configured for axial sealing between the valve member and the valve seats 270 and 272. Axial sealing achieves the intended fluid shutoff without the possibility of binding between components. In contrast, prior art regulator valves identified in the background section utilize a radial sealing in which tight tolerances must be maintained between the sidewalls of a sliding valve member and the interior wall of the valve body. Components sliding relative to each other within tight tolerances renders the prior art temperature regulator valve susceptible to binding or sticking. The sliding tolerances of the prior art may also permit leakage between the valve member and the valve body, preventing liquid tight closure. Additionally, the reduced need for tight tolerances in the present inventive disclosure is better suited for manufacturing in injection molded resins, as preferred in disclosures presented herein.

Advantageously, the double counterbalancing function of the shape memory actuator spring 258 and the concentrically located reset spring 252 provides a compact regulator valve design that can be readily packaged into the relatively space-limited fluid filter 100 assembly.

Advantageously, the temperature regulator valve 224 in exemplary aspects utilizes a shape memory alloy (SMA) actuator (SMA spring 258 in exemplary embodiment FIGS. 2A and 2B, nitinol spring in a further exemplary embodiment) to enable the thermostatic function of the valve 224. The shape memory alloy actuator has a dual function: 1) detecting the mixture temperature of the fluid within the filter housing 232; and 2) activating the valve stem 254 to redirect fluid flow between the fluid filter chamber 238 and the recirculation outlet port 236.

Advantageously, the temperature regulator valve 224 as disclosed may be preassembled as a separate component and then later installed into a filter housing on the production line, enabling higher flexibility in the manufacturing process and avoiding complex assembly operations as well as the need to provide stations for small components in the fluid filter manufacturing process.

Advantageously, the temperature regulator valve 224 may be realized and stocked as a standardized separate component, reusable across multiple filter housing designs and differing applications, thereby reducing the number of different component parts that must be maintained on hand to support manufacturing.

Advantageously, the valve base 244 and valve cap 246 may be advantageously produced from plastic resin material and joined using snap-fit techniques, welding or gluing. This capability eliminates the need for any additional hardware or fixing element and provides for low manufacturing cost.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A fluid filter comprising:

a filter housing having a fluid inlet port, a fluid outlet port and a chamber for receiving a fluid filter element therein;

a thermostatic regulator valve mounted within said chamber in an interior of said filter housing, said valve comprising a valve body defining a valve inlet port, a valve outlet port and a recirculation passage, said recirculation passage in fluid communication with said chamber;

a valve member movable between a first position and a second position for redirecting fluid flow, wherein in said first position said valve inlet port is in communication with said recirculation passage and said valve outlet port is blocked, wherein in said second position said valve inlet port is in communication with said valve outlet port and said recirculation passage is blocked;

an actuator member is positioned within said chamber, immersed in and responsive to fluid mix temperature within said chamber and having a predefined desired actuation temperature, said actuator operational to urge said valve member into said second position when said mix temperature warms to said actuation temperature;

wherein said mix temperature corresponds to a blending of fluid entering said fuel inlet port together with fluid exiting said recirculation passage within said chamber.

2. The fluid filter according to claim 1, wherein hydraulic pressure of said fluid is operable to move said valve member from said second position to said first position when mix temperature drops below said predefined actuation temperature.

3. The fluid filter according to claim 1, further comprising at least one reset spring member configured to elastically urge said valve member into said first position when mix temperature drops below said predefined actuation temperature.

4. A fluid filter, comprising:

a filter housing having a fluid inlet port, a fluid outlet port and a chamber for receiving a fluid filter element therein;

a thermostatic regulator valve integrated into said filter housing, said valve comprising a valve body defining a valve inlet port, a valve outlet port and a recirculation passage, said recirculation passage in fluid communication with said chamber:

a valve member movable between a first position and a second position for redirecting fluid flow, wherein in said first position said valve inlet port is in communication with said recirculation passage and said valve outlet port is blocked, wherein in said second position said valve inlet port is in communication with said valve outlet port and said recirculation passage is blocked;

an actuator member responsive to fluid mix temperature and having a predefined desired actuation temperature, said actuator operational to urge said valve member into said second position when said mix temperature warms to said actuation temperature;

wherein said mix temperature corresponds to a blending of fluid entering said fuel inlet port together with fluid exiting said recirculation passage within said chamber:

wherein said actuator member comprises a shape memory alloy having a transformation temperature, said shape memory alloy changing in shape when said fluid warms to said transformation temperature, said shape change urging said valve member into said second position;

wherein said transformation temperature is determined from said desired actuation temperature.

5. The fluid filter according to claim 4, wherein hydraulic pressure of said fluid is operable to move said valve member from said second position to said first position when mix temperature drops below said predefined actuation temperature.

6. The fluid filter according to claim 4, further comprising at least one reset spring member configured to elastically urge said valve member into said first position when mix temperature drops below said predefined actuation temperature.

7. A fuel filter for filtering fuel and regulating fuel temperature comprising:

a filter housing having a fuel inlet port, a fuel outlet port and a chamber for receiving a fluid filter element therein;

a thermostatic regulator valve integrated into said filter housing, said valve comprising a valve body defining a valve inlet port, a valve outlet port and a recirculation passage, said recirculation passage in fluid communication with said chamber;

a valve member movable between a first position and a second position for redirecting fluid flow, wherein in said first position said valve inlet port is in communication with said recirculation passage and said valve outlet port is blocked, wherein in said second position said valve inlet port is in communication with said valve outlet port and said recirculation passage is blocked;

at least one reset spring member configured to elastically urge said valve member into said first position; and a shape memory alloy actuator member having a transformation temperature, said shape memory alloy changing in shape when shape memory alloy temperature warms to said transformation temperature, said shape change operable to urge said valve member into said second position;

wherein said actuator member is responsive to a mix temperature of said fuel in said housing, said mix temperature corresponding to a blending of fuel entering said fuel inlet port together with fuel exiting said recirculation passage within said chamber; and wherein said transformation temperature is selected to regulate fuel temperature at or above a desired minimum fuel temperature.

8. The fuel filter according to claim 7 wherein said valve body includes an outlet seat and a recirculation seat, said seats configured to permit closeable sealing against said valve member to perform said fluid redirection; and wherein said valve body and said seats are configured for closeable sealing in an axial direction relative to movement of said valve member.

9. The fuel filter according to claim 7 wherein said valve member includes a two sided valve disc configured to enable axial sealing of said valve member against a maximum of one of said seats at a time.

10. The fuel filter according to claim 8, wherein said actuator member is a coiled shape memory alloy spring; and wherein said reset spring member and said actuator member are arranged concentrically and act opposingly to effect the position of said valve member.

11. The fuel filter according to claim 10, wherein said valve body is substantially "T" shaped;

wherein said reset spring member is received about a valve shaft, said shaft secured at one end to said valve member and secured at an opposing end to an actuator engagement member; and wherein said actuator member engages against said valve body at a first end and is engageable against said actuator engagement member at a second end.

12. The fuel filter according to claim 11 wherein said regulator valve and filter housing comprise molded plastic resin.

13. The fuel filter according to claim 12, wherein said filter housing includes a receptacle sized and configured to mountably receive said fuel regulator valve;

wherein said regulator valve is realized as a separate standardized component applicable to multiple filter housing types; and wherein said regulator valve is configured for snap-in assembly into said receptacle.

14. The fuel filter according to claim 13, wherein said receptacle includes curved wing portions configured to provide fluid flow closure between the receptacle and said valve body.

15. The fuel filter according to claim 14 further comprising:

a positioning tab secured to an outer wall of said regulator valve; and an alignment slot provided in a wall of said receptacle, said positioning tab and alignment slot cooperatively oriented, shaped and sized to engage during installation to ensure correct alignment of said regulator valve.

16. The fluid filter according to claim 7, wherein said actuator comprises a nitinol coil spring.

17. The fluid filter according to clam 7, wherein said fuel regulator valve is positioned within said filter housing chamber, wherein any leakage from said valve is contained within said filter housing.

18. A fuel delivery system for an internal combustion engine, comprising:

a fuel filter according to claim 7, wherein said inlet port is in communication with a fuel return line from said engine;

said outlet line is in communication with a second fuel return line to a fuel tank;

said fuel inlet port is in communication with a fuel supply line from said fuel tank; and said fuel outlet port is in communication with a pump configured to draw said fuel from said tank through said filter.

* * * * *